US012565787B2

(12) United States Patent
Latierre et al.

(10) Patent No.: US 12,565,787 B2
(45) Date of Patent: Mar. 3, 2026

(54) SYSTEMS AND METHODS OF DISPLAYING TEMPERATURE ON EQUIPMENT SUCH AS AUTOMATIC SWIMMING POOL CLEANERS AND ASSOCIATED COMPONENTS

(71) Applicant: ZODIAC POOL CARE EUROPE, Belberaud (FR)

(72) Inventors: Florence Latierre, Toulouse (FR); Thomas Rosin, Auterive (FR); Simon Duffaut, Castelginest (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 289 days.

(21) Appl. No.: 17/952,099

(22) Filed: Sep. 23, 2022

(65) Prior Publication Data

US 2023/0108168 A1 Apr. 6, 2023

Related U.S. Application Data

(60) Provisional application No. 63/251,114, filed on Oct. 1, 2021.

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/16; E04H 4/1636; E04H 4/1654
See application file for complete search history.

(56) References Cited

U.S. PATENT DOCUMENTS 302,353 A * 7/1884 Pattison ..... E04H 4/1654 15/160
4,322,297 A * 3/1982 Bajka ..... B01D 37/04 210/138

(Continued)

FOREIGN PATENT DOCUMENTS

EP 3199725 A1 8/2017
WO 2004019295 A1 3/2004
WO WO-2017046808 A1 * 3/2017 ..... E04H 4/1209

OTHER PUBLICATIONS

International Application No. PCT/IB2022/059052, International Preliminary Report on Patentability mailed on Apr. 11, 2024, 9 pages.

(Continued)

*Primary Examiner* — Michael D Jennings
(74) *Attorney, Agent, or Firm* — Kilpatrick Townsend & Stockton LLP

(57) ABSTRACT

An automatic swimming pool cleaner system includes an automatic swimming pool cleaner and optionally a control box. The automatic swimming pool cleaner and/or the control box may display a temperature measurement of a swimming pool determined by the automatic swimming pool cleaner within the swimming pool on the control box associated with the automatic swimming pool cleaner and/or on the automatic swimming pool cleaner. A method includes displaying on an automatic swimming pool cleaner or on the control box associated with the automatic swimming pool cleaner a temperature measurement of a swimming pool determined by the automatic swimming pool cleaner within the swimming pool.

8 Claims, 3 Drawing Sheets

(56) References Cited

U.S. PATENT DOCUMENTS

| | | | | |
|---|---|---|---|---|
| 9,250,626 | B2 | 2/2016 | Michelon | |
| 9,506,262 | B2 * | 11/2016 | Tavor | E04H 4/1654 |
| 2005/0006288 | A1 * | 1/2005 | Bauckman | E04H 4/1654<br>210/167.16 |
| 2015/0161870 | A1 * | 6/2015 | Podlisker | G08B 21/08<br>340/573.6 |
| 2016/0145884 | A1 | 5/2016 | Erlich et al. | |
| 2018/0135325 | A1 * | 5/2018 | Schloss | E04H 4/1654 |
| 2019/0314243 | A1 * | 10/2019 | MacCallum | H04L 12/281 |
| 2019/0338545 | A1 * | 11/2019 | Duffaut | E04H 4/148 |
| 2021/0366259 | A1 * | 11/2021 | Guzelgunler | E04H 4/06 |

OTHER PUBLICATIONS

International Application No. PCT/IB2022/059052, International Search Report and Written Opinion mailed on Jan. 9, 2023, 12 pages.

* cited by examiner

Blue
<28°C

Green
28°C<T<32°C

Red
>32°C

SYSTEMS AND METHODS OF DISPLAYING TEMPERATURE ON EQUIPMENT SUCH AS AUTOMATIC SWIMMING POOL CLEANERS AND ASSOCIATED COMPONENTS

REFERENCE TO RELATED APPLICATION

This application claims the benefit of U.S. Provisional patent Application No. 63/251,114, filed on Oct. 1, 2021 and entitled SYSTEMS AND METHODS OF DISPLAYING TEMPERATURE ON EQUIPMENT SUCH AS AUTOMATIC SWIMMING POOL CLEANERS AND ASSOCIATED COMPONENTS, the content of which is hereby incorporated by reference in its entirety.

FIELD OF THE INVENTION

This invention relates to systems and methods of cleaning water-containing vessels such as swimming pools and spas and more particularly, although not necessarily exclusively, to causing an automatic swimming pool cleaner ("APC"), and/or a control box associated with the APC, to display a temperature of the swimming pool or spa, as measured by the APC.

BACKGROUND OF THE INVENTION

Commonly-owned U.S. Pat. No. 9,250,626 to Michelon describes an exemplary apparatus (often called a "robot" or a "robotic APC") for cleaning a swimming pool. The apparatus includes wheels or other motive elements and is configured to travel autonomously within the pool. It further may be connected to a control box positioned near the pool. Traditional APCs that measure a temperature of a pool may involve use of an additional device to display the measurement. As one of many examples, when an APC measures temperature, a user device and/or a mobile device may need to be connected to the APC to display the temperature. However, a user may not always have such an additional device readily available for connecting to the APC.

SUMMARY

In view of the limitations of traditional approaches, described herein are systems and methods for displaying a temperature of a swimming pool measured by an automatic swimming pool cleaner (APC) without requiring an additional device such as a smartphone and/or other smart device. In certain embodiments, the temperature may be displayed on various components of an APC, including but not limited to the cleaner itself and/or a control box associated with the cleaner. The systems and methods described herein may provide the measured temperature using various types of visual indicators (e.g., colors, figures, etc.) and/or with varying characteristics based on the measured temperature. In addition to providing temperature information, the systems and methods described herein may allow for other data measured by the APC, such as but not limited to a pH level, a conductivity, an oxidation reduction potential (ORP), etc., to be provided to a user without requiring an additional device.

According to certain embodiments, a method includes displaying on an APC a temperature measurement of a swimming pool determined by the APC within the swimming pool.

According to some embodiments, a method includes displaying a temperature measurement of a swimming pool on a control box associated with an APC, where the temperature measurement is determined by the APC within the swimming pool.

According to various embodiments, a method includes displaying on an APC or a control box associated with the APC, a temperature measurement of a swimming pool determined by the APC within the swimming pool.

According to some embodiments, an APC system for a swimming pool includes a control box and an APC. The APC includes a sensor for measuring a characteristic of water of the swimming pool, and at least one of the control box or the APC includes a communication region for displaying the measured characteristic of the water of the swimming pool.

According to certain embodiments, a method includes displaying on an automatic swimming pool cleaner (APC) or a control box associated with the APC a water characteristic measurement of a swimming pool determined by the APC within the swimming pool.

Embodiments covered by this patent are defined by the claims below, not this summary. This summary is a high-level overview of various embodiments and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

BRIEF DESCRIPTION OF THE DRAWINGS

The specification makes reference to the following appended figures, in which use of like reference numerals in different figures is intended to illustrate like or analogous components.

DESCRIPTION OF THE INVENTION

Described herein are systems and methods for displaying a temperature (and/or other data measured by an APC) without relying on a user having a smartphone, or other smart device. The temperature (and/or other measured data) may be displayed on the APC and/or at a control box associated with the APC. As a result, the temperature (and/or other measured data) may be indicated to the user without a smartphone.

Figure 1:
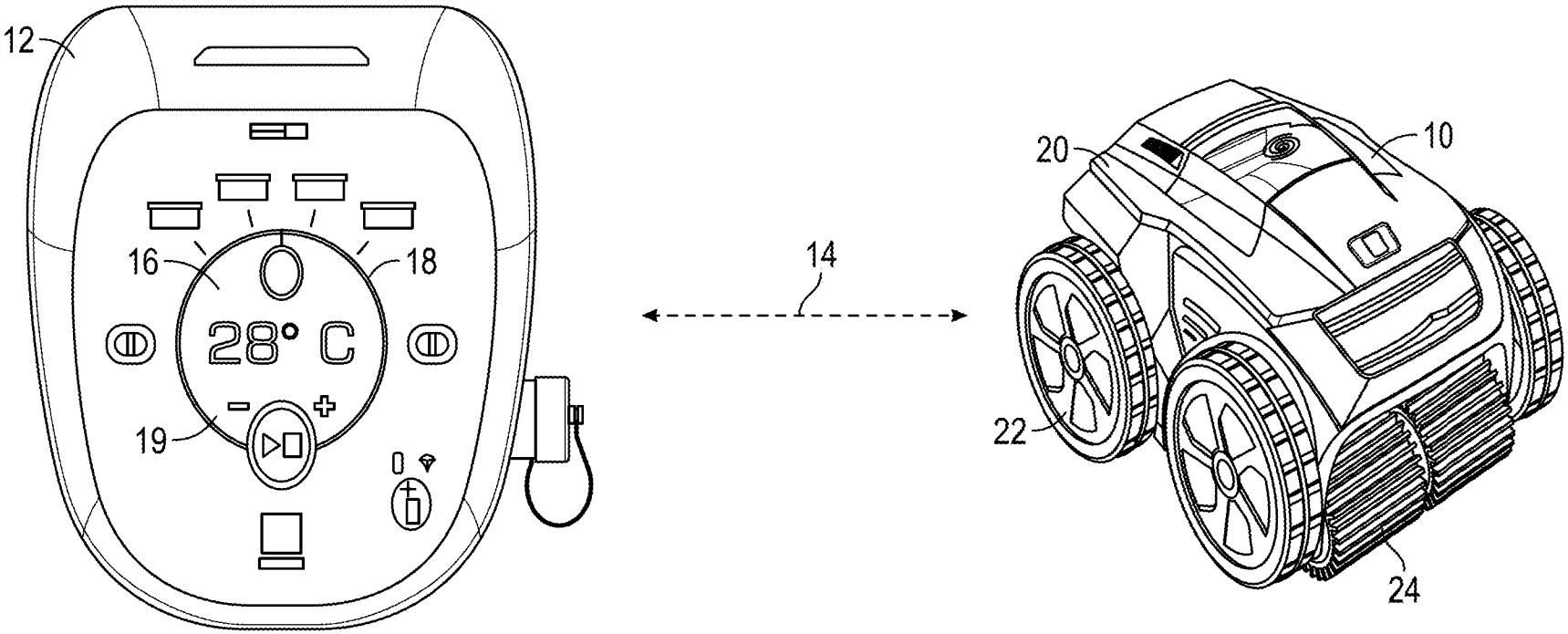
FIG. 1 illustrates an example of an APC and a control box for the APC according to embodiments.

FIG. 1 illustrates an example of an APC system that includes an APC 10 and optionally with a control box 12 according to embodiments. As represented by the dashed arrows 14, the APC 10 may be connected to the control box 12, such as via cabling and/or other mechanisms or devices as desired, thereby enabling data communication between the APC 10 and the control box 12 and/or electrical power supply. In certain embodiments, the control box 12 includes a connector (e.g., a transmitting connector) that may cooperate with a receiving connector of the APC 10 to electrically link the control box 12 with the APC 10. In some embodiments, the control box 12 may be dedicated to the APC 10. The control box 12 may be dedicated to the particular APC 10 and may be installed at a particular location within a pool environment (e.g., at a location on a pool deck) and/or may be movable with the APC 10. Optionally, the control box 12 may float and/or otherwise be positionable within water of the pool or spa. A communication region 16 with one or more visual indicators 19 may be provided on the APC 10 and/or the control box 12 as discussed in detail below.

The APC 10 may be a robotic cleaner using electrical power for movement and cleaning. Accordingly, the APC 10 may include a body 20 having an on-board pump and at least one motor (and preferably at least two motors). An on-board or remote controller may be employed, and the APC 10 further may include motive elements 22 such as but not limited to wheels, tracks, combinations thereof, and/or other motive elements as desired to facilitate movement of the APC 10. Optionally, the motive elements 22 may be used to scrub (clean) the surface in which they are in contact. A cleaning element 24 such as but not limited to a brush assembly may be provided to perform a cleaning action.

In certain embodiments, the APC 10 includes a temperature sensor for measuring a temperature of a swimming pool or spa. Additionally or alternatively, the APC 10 may include sensors for measuring other characteristics of the swimming pool or spa, such as but not limited to sensors for measuring conductivity, pH levels, ORP, combinations thereof, and/or other suitable sensors as desired. In the embodiment illustrated in FIG. 1, the APC 10 may send the temperature measurement to the control box 12. The APC 10 may send the temperature measurement in real time/as the temperature is measured, although in other embodiments the APC 10 may send the temperature measurement at predetermined intervals, irregular intervals, based on a prompt from a user, and/or as otherwise desired. Additionally or alternatively, the measurements from the other sensors may also be sent to the control box 12.

The control box 12 includes the communication region 16 for communicating the temperature measurement to a user via one or more visual indicators 19. The visual indicators 19 may be various devices or mechanisms as desired, including but not limited to electric-based visual indicators, mechanical-based visual indicators, chemical-based visual indicators, etc. In the embodiment illustrated in FIG. 1, the visual indicator 19 of the communication region 16 includes a screen 18, and the control box 12 may display the temperature measurement on the screen 18 for communicating the temperature measurement to a user. In certain embodiments, the screen 18 may include one or more light-emitting diodes (LEDs) for displaying the temperature measurement. In the embodiment illustrated, the LEDs are controlled to form numerical figures based on the temperature measurement.

In certain embodiments, instead of displaying the temperature measurement numerically, the control box 12 may present the temperature measurement using a different visual indicator and/or by controlling characteristics of the visual indicators. Characteristics of the visual indicators may include, but are not limited to, colors, patterns, images, icons, shapes, visual intensity, combinations thereof, and/or other characteristics as desired. As a non-limiting example, temperatures within predefined ranges may be associated with a particular text display. For example, temperatures above a threshold may be associated with a display of "too high" on the screen 18. Other displays may include "low," "medium," "high," or any other suitable text to characterize the temperature. The predefined ranges may be provided by the user (e.g., corresponding to temperature ranges that the user desires the pool water to be at) and/or may be determined by the APC and/or pool system (e.g., corresponding with various characteristics of the water of the pool).

One or more characteristics of the visual indicators may be associated with the predefined ranges, such as but not limited to colors, patterns, combinations thereof, etc. As a non-limiting example, the LEDs may emit light with a solid pattern at a first (e.g., low) temperature, may emit light in a blinking pattern at a first frequency at a second (e.g., medium) temperature, and may emit light in a blinking pattern at a second frequency at a third (e.g., high) temperature. As another non-limiting example, the predefined ranges may be associated with a color output on the screen 18. For example, temperatures in a first range may result in the screen 18 displaying a first color (e.g., green), temperatures in a second range may result in the screen 18 displaying a second color (e.g., red), and temperatures in a third range may result in the screen 18 displaying a third color (e.g., blue). Optionally, a plurality of characteristics are controlled based on the temperature measurement.

Optionally, a controller may be communicatively coupled with the sensor(s) of the APC 10, and the controller may control the visual indicators 19 and/or the communication region 16 based on the measured temperature. In other embodiments, the controller may be omitted, and the visual indicators 19 and/or the communication region 16 may display the measured temperature automatically without requiring a controller. As a non-limiting example and as discussed in detail below, the visual indicators 19 may include a thermochromic ink that changes colors based on the temperature of the water.

Figure 2:
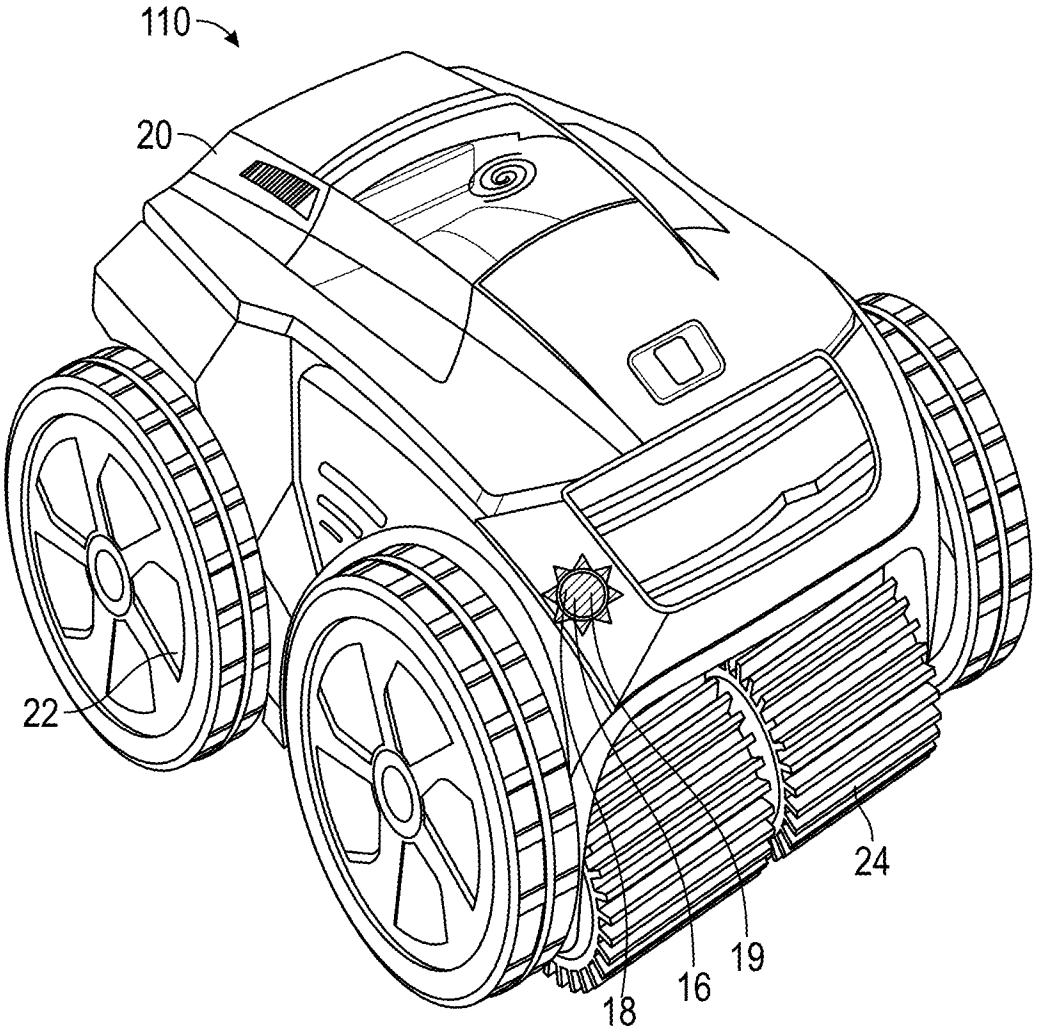
FIG. 2 illustrates an example of an APC according to embodiments.

FIG. 2 illustrates another example of an APC system that includes an APC 110 according to embodiments. The APC 110 is substantially similar to the APC 10 except that the communication region 16 is provided on the body 20 of the APC 110. In other embodiments, the communication region 16 may be provided at other locations on the APC 110 as desired. Compared to the APC 10, which communicates with the control box 12 to display the temperature measurement, the APC 110 itself can display the temperature measurement (or other characteristic measured by the APC 110 as desired).

Figure 3A:
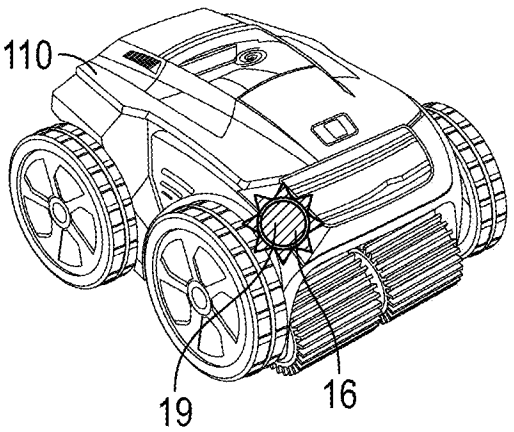
FIGS. 3A-C illustrate the APC of FIG. 2 displaying different measured temperatures according to embodiments.
Figure 3B:
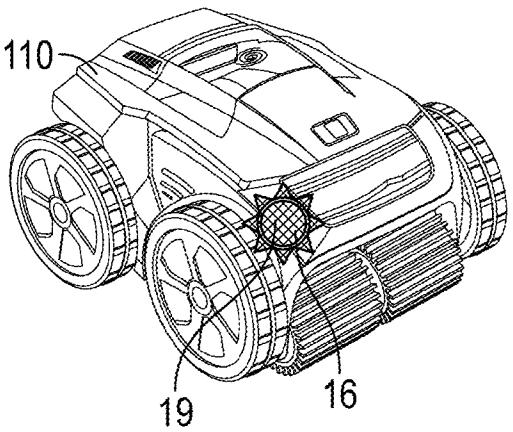
Figure 3C:
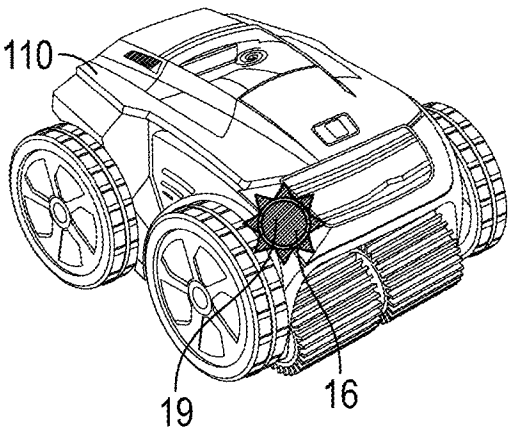

In certain embodiments, upon measuring the temperature (or other characteristic) of the pool water, the APC 110 may display the temperature and/or or a visual indicator 19 of the temperature at the communication region 16. As a non-limiting example, similar to the control box 12 in FIG. 1, the APC 110 may display the temperature measurement numerically, textually, or as colors at the communication region 16 using LEDs or other light source. FIGS. 3A-C illustrate non-limiting examples where a color of LEDs as the visual indicator are controlled and/or changed based on the measured temperature being within predefined ranges. In FIGS. 3A-C, the communication regions 16 and visual indicators 19 have been enlarged and exaggerated for clarity of the figures and to better illustrate changes of the communication regions 16 and/or visual indicators 19. In particular, in the example illustrated, the visual indicator 19 may be a first color (e.g., blue in FIG. 3A) based on the temperature being a "low" temperature (e.g., less than 28° C.), a second color (e.g., green in FIG. 3B) based on the measured temperature being a "medium" temperature (e.g., from 28° C. to 32° C.), and a third color (e.g., red in FIG. 3C) based on the temperature being a "high" temperature (e.g., greater than 32° C.).

As mentioned, the visual indicators 19 may be various types of visual indicators as desired and need not be electric-based. As a non-limiting example, in some embodiments, the APC 110 (or the APC 10) may include thermochromic ink as visual indicators 19 at the communication region 16 that can change colors based on the temperature of the water. As the temperature changes, the thermochromic ink can change colors. For example, the thermochromic ink may turn blue if the temperature of the water is below 28° C., green if the temperature of the water is between 28° C. and 32° C., and red if the temperature of the water is greater than 32° C.

Persons skilled in the appropriate art will recognize that the colors and temperature values are merely examples of a wide variety of colors and temperature ranges that may be provided. Accordingly, the APC 110 may display any color corresponding to any temperature(s) at the communication region 16. Although one example of a communication region 16 is illustrated in FIGS. 2 and 3A-C, the communication region 16 may be any suitable size, shape, etc. at any suitable location or locations, and any number of communication region 160 may be included. In some cases, rather than having one or more communication region 16, the APC 110 (or a portion or portions thereof) may change color depending on the sensed water temperature.

The subject matter of embodiments is described herein with specificity to meet statutory requirements, but this description is not necessarily intended to limit the scope of the claims. The claimed subject matter may be embodied in other ways, may include different elements or steps, and may be used in conjunction with other existing or future technologies.

Exemplary Concepts and Combinations of Features of the Invention May Include:

A. A method of displaying on an APC a temperature measurement of a swimming pool determined by the APC within the swimming pool.

B. The method of statement A, wherein determining the temperature measurement comprises measuring a temperature of the swimming pool with a sensor of the APC.

C. The method of statement A or B, wherein displaying the temperature measurement comprises displaying a visual indicator associated with the temperature measurement.

D. The method of any one of statements A-C, wherein displaying the temperature measurement comprises using thermochromic ink that changes colors depending on the measured temperature.

E. A method of displaying a temperature measurement of a swimming pool on a control box associated with an APC, wherein the temperature measurement is determined by the APC within the swimming pool.

F. A method of displaying on an APC or a control box associated with the APC a temperature measurement of a swimming pool determined by the APC within the swimming pool.

G. The method of statement F, further comprising determining the temperature measurement of the swimming pool using the APC.

H. The method of statement F or G, wherein determining the temperature measurement comprises measuring a temperature of the swimming pool with a sensor of the APC.

I. The method of any of statements F-H, wherein displaying the temperature measurement of the swimming pool comprises displaying the temperature measurement on the APC.

J. The method of any of statements F-I, wherein displaying the temperature measurement of the swimming pool comprises displaying the temperature measurement on the control box.

K. The method of any of statements F-J wherein displaying the temperature measurement comprises displaying a visual indicator associated with the temperature measurement.

L. The method of any of statements F-K wherein displaying the visual indicator comprises controlling at least one characteristic based on the temperature measurement.

M. The method of any of statements F-L wherein the at least one characteristic comprises a color, text, a pattern of light, an intensity of light, or an image.

N. The method of any of statements F-M wherein controlling the at least one characteristic is based on the temperature measurement being within a predefined temperature range.

O. The method of any of statements F-N wherein displaying the temperature measurement comprises displaying the temperature using thermochromic ink that changes colors depending on the measured temperature.

P. An APC system for a swimming pool, the APC system comprising a control box and an APC, wherein the APC comprises a sensor for measuring a characteristic of water of the swimming pool, and wherein at least one of the control box or the APC comprises a communication region for displaying the measured characteristic of the water of the swimming pool.

Q. The APC system of statement P, wherein the communication region comprises a visual indicator, and wherein at least one characteristic of the visual indicator changes based on the measured characteristic of the water of the swimming pool.

R. The APC system of statement P or Q, wherein the at least one characteristic of the visual indicator comprises a color of the visual indicator.

S. The APC system of any of statements P-R, wherein the visual indicator comprises a thermochromic ink.

T. The APC system of any of statements P-S, wherein the characteristic of the water of the swimming pool is a temperature of the water, a pH of the water, a conductivity of the water, or an ORP of the water.

U. The APC system of any of statements P-T, wherein the communication region is on a body of the APC.

V. The APC system of any of statements P-U, wherein the communication region is on the control box, and wherein the communication region comprises a display screen.

W. A method of displaying a water characteristic measurement of a swimming pool determined by an APC within the swimming pool on the APC or a control box associated with the APC.

X. The method of statement W, wherein the characteristic of the water of the swimming pool is a temperature of the water, a pH of the water, a conductivity of the water, or an ORP of the water.

Y. The method of statement W or X, wherein displaying the water characteristic measurement comprises displaying a visual indicator associated with the water characteristic measurement.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The foregoing is provided for purposes of illustrating, explaining, and describing embodiments of the present invention. Modifications and adaptations to these embodiments will be apparent to those skilled in the art and may be made without departing from the scope or spirit of the invention. Additionally, the word "pool" and phrase "swimming pool" as used herein may include vessels such as spas and hot tubs and other water containing vessels used for recreation or therapy within their definitions.

That which is claimed:

1. An automatic swimming pool cleaner system for a swimming pool, the automatic swimming pool cleaner system comprising:

a self-propelled pool cleaner, wherein the self-propelled pool cleaner comprises:

(i) a sensor on the self-propelled pool cleaner for measuring a characteristic of water of the swimming pool; and (ii) a screen on the self-propelled pool cleaner, wherein the screen on the self-propelled pool cleaner is configured to display the characteristic of the water of the swimming pool measured by the sensor on the self-propelled pool cleaner.

2. The automatic swimming pool cleaner system of claim 1, wherein self-propelled pool cleaner further comprises a visual indicator, and wherein at least one characteristic of the visual indicator changes based on the measured characteristic of the water of the swimming pool.

3. The automatic swimming pool cleaner system of claim 2, wherein the at least one characteristic of the visual indicator comprises a color of the visual indicator.

4. The automatic swimming pool cleaner system of claim 2, wherein the visual indicator comprises a thermochromic ink.

5. The automatic swimming pool cleaner system of claim 1, wherein the characteristic of the water of the swimming pool is a temperature of the water, a pH of the water, a conductivity of the water, or an ORP of the water.

6. A method comprising:

measuring, by a sensor on a self-propelled pool cleaner, a measurement of a water characteristic of water of a swimming pool in which the self-propelled pool cleaner is operating; and displaying the water characteristic measurement measured by the sensor on the self-propelled pool cleaner on a screen, wherein the screen is on the self-propelled pool cleaner.

7. The method of claim 6, wherein the characteristic of the water of the swimming pool is a temperature of the water, a pH of the water, a conductivity of the water, or an ORP of the water.

8. The method of claim 6, wherein displaying the water characteristic measurement comprises displaying a visual indicator associated with the water characteristic measurement.

* * * * *